US007819982B2

(12) United States Patent
Cho et al.

(10) Patent No.: US 7,819,982 B2
(45) Date of Patent: Oct. 26, 2010

(54) DISHWASHER AND METHOD OF CONTROLLING THE SAME

(75) Inventors: In Haeng Cho, Changwon-si (KR); Joung Hun Kim, Changwon-si (KR)

(73) Assignee: LG Electronics Inc., Seoul (KR)

( * ) Notice: Subject to any disclaimer, the term of this patent is extended or adjusted under 35 U.S.C. 154(b) by 354 days.

(21) Appl. No.: 10/574,623

(22) PCT Filed: Sep. 9, 2005

(86) PCT No.: PCT/KR2005/002989

§ 371 (c)(1),
(2), (4) Date: Apr. 5, 2006

(87) PCT Pub. No.: WO2006/028356

PCT Pub. Date: Mar. 16, 2006

(65) Prior Publication Data

US 2007/0151578 A1 Jul. 5, 2007

(30) Foreign Application Priority Data

Sep. 9, 2004 (KR) ..... 10-2004-0072129

(51) Int. Cl.
*B08B 3/10* (2006.01)

(52) U.S. Cl. ..... 134/18; 134/25.2

(58) Field of Classification Search ..... 134/18, 134/25.2, 34

See application file for complete search history.

(56) References Cited

U.S. PATENT DOCUMENTS

| | | | | |
|---|---|---|---|---|
| 4,159,211 | A * | 6/1979 | Hoffman et al. | 134/57 D |
| 5,331,984 | A * | 7/1994 | Isagawa | 134/57 D |
| 5,792,276 | A * | 8/1998 | Driessen | 134/18 |
| 6,615,850 | B1 | 9/2003 | Homung | |
| 6,694,990 | B2 | 2/2004 | Spanyer et al. | |
| 2003/0168087 | A1 * | 9/2003 | Inui et al. | 134/57 D |

FOREIGN PATENT DOCUMENTS

| | | | |
|---|---|---|---|
| JP | 14-336179 | A | 11/2002 |
| JP | 15-284669 | A | 10/2003 |
| KR | 1995-9390 | A | 4/1995 |
| KR | 1996-16834 | A | 6/1996 |
| KR | 1998-35119 | A | 8/1998 |

OTHER PUBLICATIONS

International Search Report dated Dec. 14, 2005.

* cited by examiner

*Primary Examiner*—Michael Barr
*Assistant Examiner*—Saeed T Chaudhry
(74) *Attorney, Agent, or Firm*—McKenna Long & Aldridge LLP

(57) ABSTRACT

A controlling method of a dishwasher is provided. The method includes performing various cycles according to a selected course, beginning a rinse cycle during the execution of the various cycles, controlling the operation of a heater and a wash pump according to whether the rinse cycle was specified as a hot rinse cycle, ending the operation of the wash pump upon completion of the rinse cycle, and performing subsequent cycles.

2 Claims, 3 Drawing Sheets

[Fig. 1]
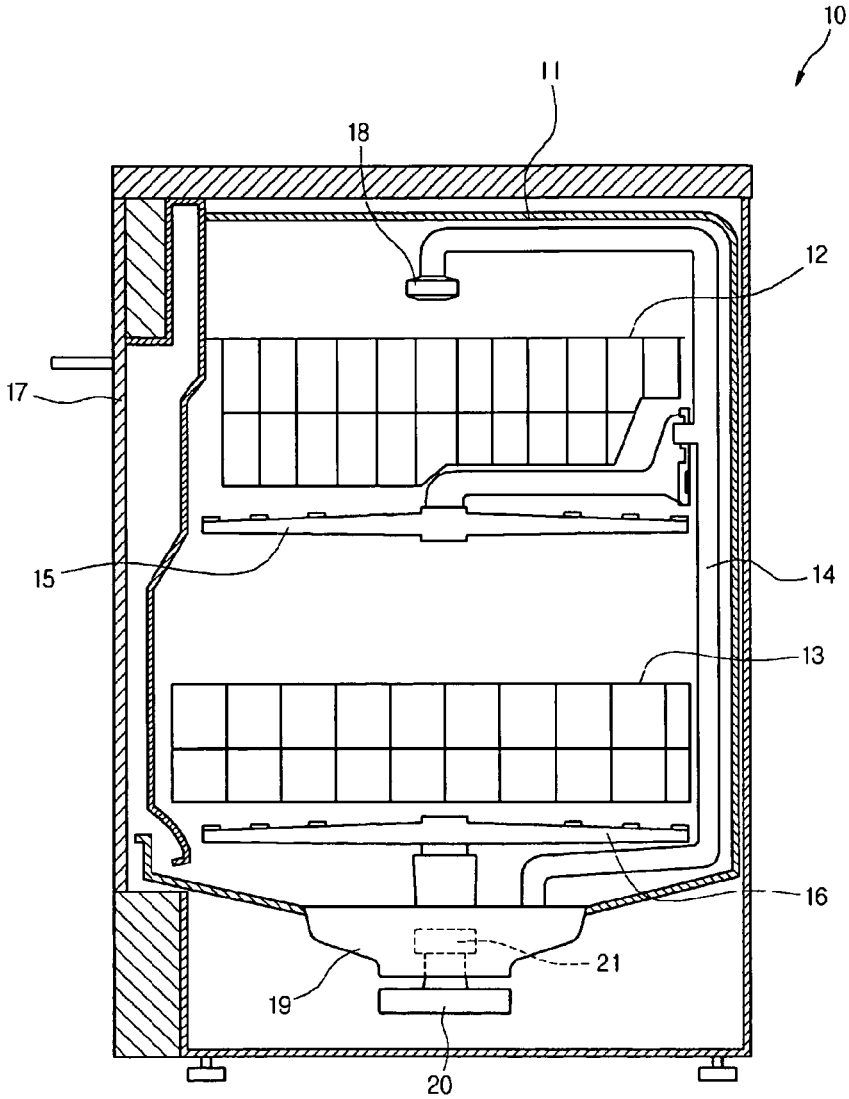
[Fig. 2]
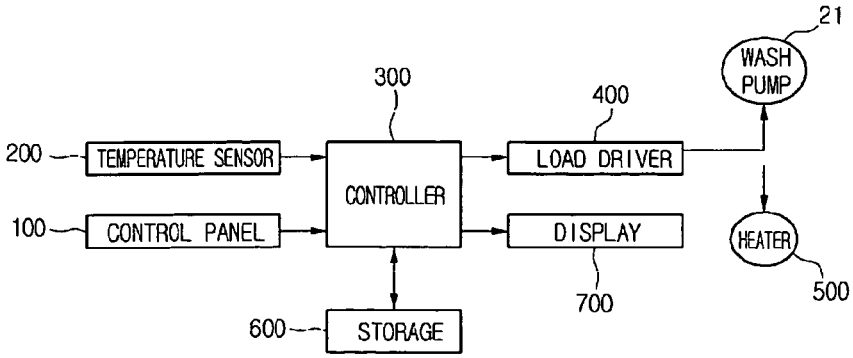

[Fig. 3]
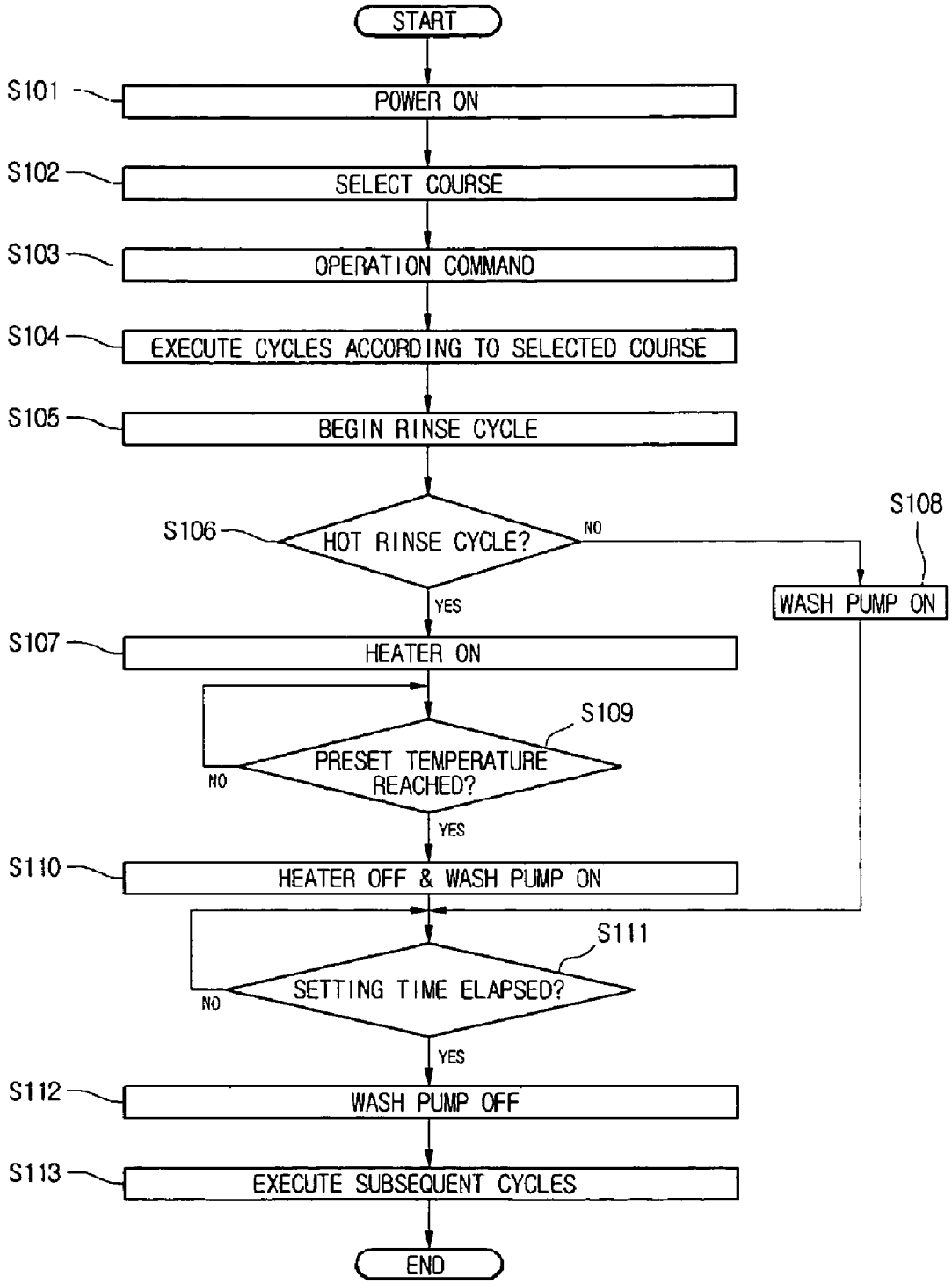

[Fig. 4]
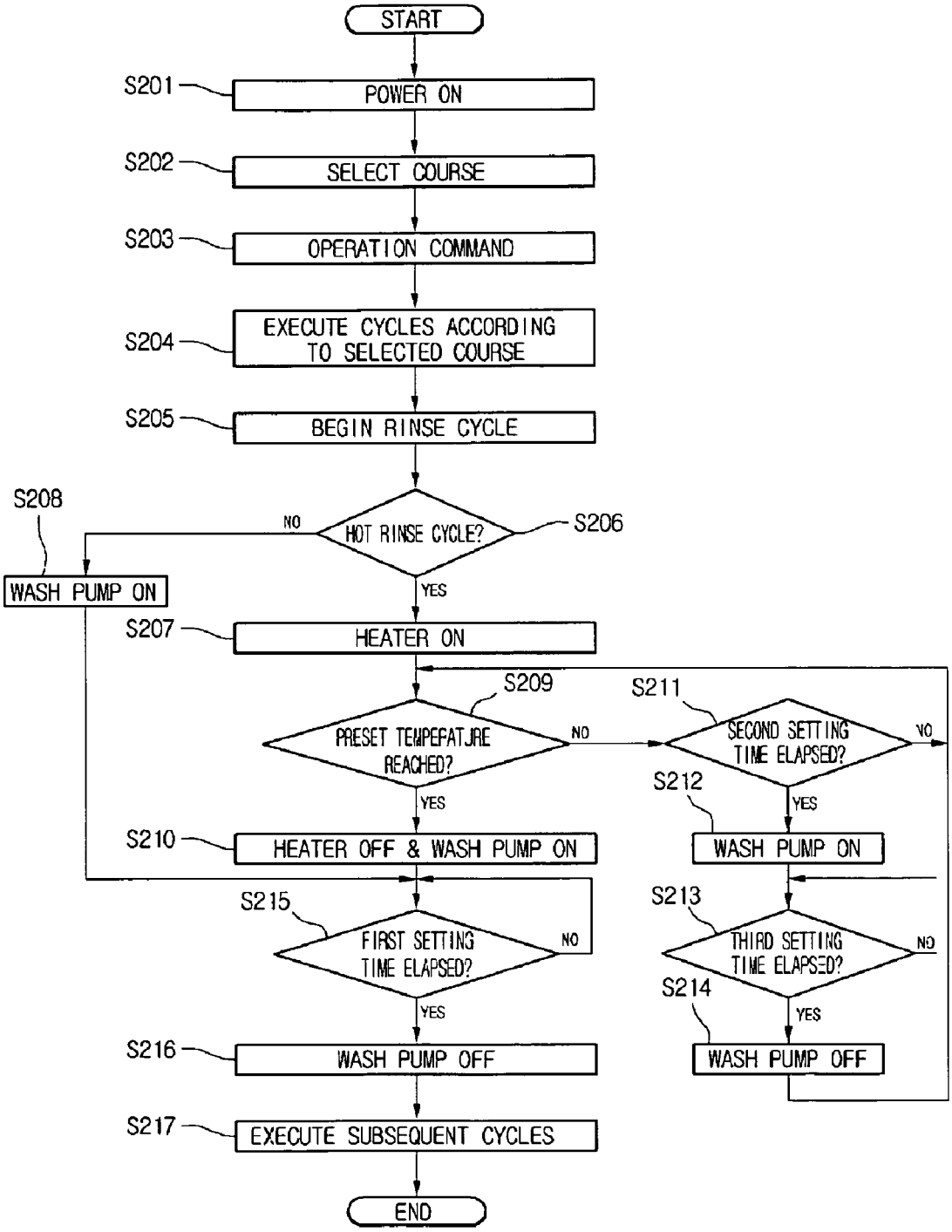

DISHWASHER AND METHOD OF CONTROLLING THE SAME

TECHNICAL FIELD

This application claims priority to International application No. PCT/KR2005/002989 filed on Sep. 9, 2005, Korean Application No. 10-2004-72129 filed on Sep. 9, 2004, both of which are incorporated by reference, as if fully set forth herein.

The present invention relates to a dishwasher, and more particularly, to a dishwasher and a method of controlling the dishwasher that can selectively activate a wash pump according to whether wash liquid attains a preset temperature during a hot rinse cycle.

BACKGROUND ART

A dishwasher is a home appliance that washes dishes by discharging high-pressure wash liquid through discharge members onto the dishes to remove impurities thereon.

In more detail, a dishwasher includes a tub forming a space inside the dishwasher for holding dishes to be washed, dish racks installed to slide in and out of the tub for holding dishes, discharge members installed inside the tub for spraying wash liquid, a sump disposed at the bottom of the tub for holding wash liquid, a wash pump assembly attached to a side of the sump for pumping the wash liquid contained in the sump to the discharge members, and a drain pump assembly for draining dirty wash liquid after dish washing is completed.

The discharge members consist of a lower arm installed above the sump, and an upper arm and a top nozzle connected to a water guide installed on an interior surface of the tub. Wash liquid is alternately pumped to the lower arm and the water guide by means of a switching valve located in the sump. In other words, during a wash cycle, the wash liquid that is alternately pumped by means of the switching valve is intermittently pumped at a predetermined interval to the lower and upper arms.

A conventional dishwasher generally activates a heater for heating wash liquid while the wash pump is operating during a hot rinse cycle. In other words, while the rinse cycle is underway, the heater heats the wash liquid to gradually warm it.

When the heating of the wash liquid and the pumping thereof are simultaneously implemented, wash liquid that has not yet reached a preset temperature is discharged from discharge members. Also, when the discharged wash liquid reenters the sump, heat is lost, so that the wash liquid takes a long time to be heated to a preset temperature.

DISCLOSURE OF INVENTION

Technical Problem

An object of the present invention is to provide a dishwasher and a method of controlling the dishwasher having an improved controlling method for heating wash liquid during a hot rinse cycle, so that the time that the wash liquid requires to reach a preset temperature is minimized.

Another object of the present invention is to provide a dishwasher and a method of controlling the dishwasher capable of maintaining a certain level of moisture on dishes in the dishwasher's racks, so that the washing effectiveness of the dishwasher increases.

Technical Solution

To achieve these objects and other advantages and in accordance with the purpose of the invention, as embodied and broadly described herein, a dishwasher according to the present invention includes: a control panel for a user to input commands with; a temperature sensor for sensing the temperature of wash liquid; a controller for controlling the dishwasher to perform each cycle according to the course selection inputted into the control panel, and selectively controlling the operation of a wash pump during a hot rinse cycle; and a load driver for controlling the operation of a heater and a wash pump according to a control signal from the controller.

According to another aspect of the present invention, there is provided a controlling method of a dishwasher including: implementing various cycles according to a selected course; beginning a rinse cycle during the operation of the various cycles; controlling the operation of the heater and wash pump, depending on whether the rinse cycle is a hot rinse cycle; ending the operation of the wash pump when the rinse cycle is completed; and executing subsequent cycles.

According to a further aspect of the present invention, there is provided a controlling method of a dishwasher that includes: selecting a wash course by a user; implementing applicable cycles according to the selected wash course; and beginning the rinse cycle from the various cycles and determining whether it is a hot rinse cycle; activating a heater if the rinse cycle selected is a hot rinse cycle, and determining whether the wash liquid has reached a preset temperature; ending the operation of the heater and operating the wash pump for a duration of a first setting time, if the wash liquid has reached the preset temperature; periodically operating the wash pump until the wash liquid attains the preset temperature, if the preset temperature has not been attained.

Advantageous Effects

During a hot rinse cycle, the above-described structure operates only the heater until wash liquid attains a targeted temperature, at which point the wash pump is activated, so that the time required to heat wash liquid is reduced.

By reducing the time required to heat wash liquid, energy consumed by operation of the heater is reduced, thereby increasing energy efficiency.

Also, when the time required to heat wash liquid in a hot rinse cycle is prolonged, food residue drying and caking on dishes can be prevented by periodically supplying moisture to the dishes, thereby increasing washing effectiveness.

BRIEF DESCRIPTION OF THE DRAWINGS

The spirit of the present invention can be understood more fully with reference to the accompanying drawings. In the drawings:

FIG. 1 is a schematic sectional view showing the structure of a dishwasher according to the present invention;

FIG. 2 is a block diagram showing the controlling structure of a dishwasher according to the present invention;

FIG. 3 is a flowchart showing a controlling method of a dishwasher according to the present invention; and FIG. 4 is a flowchart showing another embodiment of a controlling method of a dishwasher according to the present invention.

BEST MODE FOR CARRYING OUT THE INVENTION

Hereinafter, preferred embodiments of a dishwasher according to the present invention will be described in detail with reference to the accompanying drawings.

FIG. 1 is a schematic sectional view showing the structure of a dishwasher according to the present invention.

Referring to FIG. 1, the dishwasher 10 includes a tub 11 forming the outer shape and an inner washing compartment of the dishwasher 10, a door 17 formed at the front of the tub 11 for opening the dishwasher 10, and a sump 19 formed at the bottom central portion of the tub 11 for holding wash liquid.

The dishwasher 10 also includes a wash pump 21 installed in the sump 19 for pumping wash liquid, a wash motor 20 for driving the wash pump 21, a water guide 14 connected to the sump 19 for guiding wash liquid pumped by the wash pump 21, an upper arm 15 branching off from the water guide 14 and spraying wash liquid inside the tub 11, a top nozzle 18 connected to the top end of the water guide 14, and a lower arm 16 connected at the upper central portion of the sump 19 and spraying wash liquid pumped by the wash pump 21. Installed inside the sump 19 is a heater (not shown) for heating wash liquid.

Further included is an upper rack 12 installed to slide in and out of the tub 11 above the upper arm 15, and a lower rack 13 disposed above the lower arm 16. Dishes are stored in the upper and lower racks 12 and 13.

An explanation of the operation of the above-described dishwasher according to the present invention will now be given.

First, a user opens the door 17, pulls out the dish racks 12 and 13, and places dirty dishes therein. After closing the door 17, power to the dishwasher 10 is turned on, and a wash course setting is inputted. When a start button is pressed, wash liquid flows into the sump 19 and is intermittently pumped by the wash pump 21 to flow to the water guide 14 and the lower arm 16.

When a wash cycle is completed, dirty wash liquid is drained by means of a drain pump (not shown), and clean wash liquid flows into the sump 19. The wash pump 21 then operates to begin a rinse cycle.

Here, if the user has specified a hot rinse cycle, the heater installed inside the sump operates and heats the wash liquid. When the wash liquid reaches a preset temperature, the wash pump 21 operates, and the heated wash liquid is discharged inside the tub through the discharge members. After the rinse cycle is completed, the wash liquid is drained out of the dishwasher, and a drying cycle begins.

FIG. 2 is a block diagram showing the controlling structure of a dishwasher according to the present invention.

Referring to FIG. 2, the dishwasher 10 according to the present invention includes: a control panel 100 for inputting commands by a user, a temperature sensor 200 for sensing the temperature of wash liquid, a controller 300 for implementing a wash cycle according to the settings inputted into the control panel 100, a load driver 400 for controlling the operation of the wash pump 21 and heater 500 according to control signals from the controller 300, a display 700 for displaying the operational status of the dishwasher according to a signal from the controller 300, and a storage 600 for storing various reference values, etc. The controller 300 selectively controls the operation of the wash pump 21 when the heater 500 operates during a hot rinse cycle.

In the above-described control structure of a dishwasher according to the present invention, when the wash cycle ends and the rinse cycle begins, the controller 300 determines whether a hot rinse cycle was specified, and controls the operation of the heater 500 accordingly. When the wash liquid is heated by the heater 500 to a preset temperature inside the sump, the wash pump 21 is activated.

While the wash liquid is being heated inside the sump 19, if the wash pump 21 does not operate, food particles remaining on dishes can dry and harden on the dishes. In order to prevent this problem from occurring, the controller 300 may prompt the wash pump to operate over a short duration before the wash liquid is heated to the preset temperature.

A controlling method of a dishwasher according to the present invention will now be explained with reference to a flowchart.

FIG. 3 is a flowchart showing a controlling method of a dishwasher according to the present invention.

Referring to FIG. 3, a user first enters the command to switch power on to the dishwasher 10 in step S101, and enters a desired course setting and options in step S102. Next, a start button is pressed for activating the dishwasher in step S103. When the start button is pressed to initiate operation, the dishwasher begins to operate in accordance with the selected course in step S104. The dishwasher operates according to the selected course, and begins a rinse cycle in step S105 after the wash cycle is completed. When the rinse cycle begins, the controller 300 determines in step S106 whether the user specified a hot rinse cycle.

When the controller 300 determines that a hot rinse cycle was specified, it activates the heater 500 in step S107. When the wash liquid is heated by the heater 500, the controller 300 determines in step S109 if the wash liquid inside the sump has been heated to a preset temperature. If it is determined that the wash liquid has been heated to a preset temperature, operation of the heater 500 is terminated, and the wash pump is activated in step S110. If the controller 300 determines that the hot rinse cycle was not specified, the heater 500 does not operate, and only the wash pump operates in step S108.

When operation of the wash pump 21 begins, the controller determines in step Sill whether the operating time of the wash pump 21 exceeds a predetermined setting time. If the setting time is found to have elapsed, the operation of the wash pump 21 is ended in step S112, and subsequent cycles are performed in step S113.

The above controlling method allows minimization of time required to heat wash liquid inside the sump to a preset temperature, so that energy efficiency increases.

Mode for the Invention

FIG. 4 is a flowchart showing another embodiment of a controlling method of a dishwasher according to the present invention.

Referring to FIG. 4, in this embodiment of a controlling method for a dishwasher according to the present invention, the wash pump operates at a predetermined interval while wash liquid is being heated to a target temperature in a hot rinse cycle, in order to maintain moisture on dishes.

A user first enters the command to switch power on to the dishwasher 10 in step S201, and enters a desired course setting and options in step S202. Next, a start button is pressed for activating the dishwasher in step S203. When the start button is pressed to initiate operation, the dishwasher begins to operate in accordance with the selected course in step S204. The dishwasher operates according to the selected course, and begins a rinse cycle in step S205 after the wash cycle is completed. When the rinse cycle begins, the controller 300 determines in step S206 whether the user specified a hot rinse cycle.

When the controller 300 determines that a hot rinse cycle was specified, it activates the heater 500 in step S207. When the wash liquid is heated by the heater 500, the controller 300 determines in step S209 if the wash liquid inside the sump has been heated to a preset temperature. If it is determined that the wash liquid has been heated to a preset temperature, operation of the heater 500 is terminated, and the wash pump is activated in step S210. If the controller 300 determines that the hot rinse cycle was not specified, the heater 500 does not operate, and only the wash pump operates in step S208.

When operation of the wash pump 21 begins, the controller determines in step S215 whether the operating time of the wash pump 21 exceeds a first setting time. If the first setting time is found to have elapsed, the operation of the wash pump 21 is ended in step S216, and subsequent cycles are performed in step S217.

Thus, the above process is the same as the embodiment for a controlling method shown in FIG. 3.

In this embodiment, when the controller 300 determines that the wash liquid has not been heated to a preset temperature, it determines in step S211 whether a second setting time has elapsed from the time when the heater begins operation. When the second setting time is found to have been elapsed, the wash pump 21 is activated in step S212. In step S213, it is determined whether the operation of the wash pump 21 exceeds a third setting time. When the third setting time is found to be exceeded, operation of the wash pump ceases in step S214. At this time, the step S209 of determining whether the wash liquid has been heated to a preset temperature is repeated. Specifically, the wash pump 21 is regularly activated in short intervals until the wash liquid reaches a preset temperature, so that moisture is supplied to the dishes. This latter function characterizes this embodiment.

Here, the third setting time may be shorter than the second setting time, and the second setting time may be shorter than the first setting time.

While the present invention has been described and illustrated herein with reference to the preferred embodiments thereof, it will be apparent to those skilled in the art that various modifications and variations can be made therein without departing from the spirit and scope of the invention. Thus, it is intended that the present invention covers the modifications and variations of this invention that come within the scope of the appended claims and their equivalents.

INDUSTRIAL APPLICABILITY

The above dishwasher and the controlling methods thereof according to the present invention shorten the time required to heat wash liquid in a hot rinse cycle, and maintain moisture on dishes while wash liquid is being heated. Thus, energy efficiency and washing effectiveness increase, providing a wide industrial applicability.

The invention claimed is:

1. A controlling method for a dishwasher, comprising:

executing various cycles according to a selected course;

beginning a hot rinse by operating a heater for heating wash liquid;

determining whether a temperature of the wash liquid reaches a preset temperature;

ending the operation of the heater, and activating a wash pump for a first preset time when the temperature of the wash liquid reaches the preset temperature; and operating the wash pump for a duration of a third preset time after elapsing of second preset time, if the temperature of the wash liquid does not reach the preset temperature, wherein the third preset time is shorter than the second preset time and the second preset time is shorter than the first preset time.

2. The controlling method according to claim 1, further comprising:

determining whether the wash liquid reaches the preset temperature again when the second preset time does not elapse or when the third preset time elapses, wherein if the wash liquid reaches the preset temperature ending the operation of the heater, and activating the wash pump for the first preset time.

* * * * *